US012059047B2

(12) United States Patent
Becker et al.

(10) Patent No.: US 12,059,047 B2
(45) **Date of Patent: *Aug. 13, 2024**

(54) PROTECTIVE HELMET

(71) Applicant: Schuberth GmbH, Magdeburg (DE)

(72) Inventors: Jan-Christian Becker, Niederndodeleben (DE); Thomas Schulz, Koenigslutter am Elm (DE); Christian Dittmer-Peters, Koenigslutter (DE); Markus Moebius, Welsleben (DE); Thomas Hagemeier, Magdeburg (DE)

(73) Assignee: SCHUBERTH GMBH, Magdeburg (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/328,392

(22) PCT Filed: Aug. 23, 2017

(86) PCT No.: PCT/EP2017/071260

§ 371 (c)(1),
(2) Date: Feb. 26, 2019

(87) PCT Pub. No.: WO2018/037056

PCT Pub. Date: Mar. 1, 2018

(65) Prior Publication Data

US 2020/0015537 A1 Jan. 16, 2020
US 2021/0052029 A2 Feb. 25, 2021

(30) Foreign Application Priority Data

Aug. 26, 2016 (DE) ..... 10 2016 115 905.0

(51) Int. Cl.
*A42B 3/04* (2006.01)
*A42B 3/30* (2006.01)

(52) U.S. Cl.
CPC ..... *A42B 3/0406* (2013.01); *A42B 3/30* (2013.01)

(58) Field of Classification Search
CPC ..... A42B 3/0406; A42B 3/30; A42B 3/306; A42B 3/303
(Continued)

(56) References Cited

U.S. PATENT DOCUMENTS 3,422,224 A 1/1969 Curran
3,470,558 A 9/1969 Raschke
(Continued)

FOREIGN PATENT DOCUMENTS

CN 2540799 Y 3/2003
CN 1627651 A 6/2005
(Continued)

OTHER PUBLICATIONS

International Search Report for Application No. PCT/EP2017/071259, issued Dec. 14, 2017, 4 pages.
(Continued)

*Primary Examiner* — Alissa L Hoey
(74) *Attorney, Agent, or Firm* — McCarter & English LLP

(57) ABSTRACT

The invention relates to a protective helmet, and in particular a protective motorcycle helmet, comprising an outer shell (1) for distributing impact forces and a socket (2), which is firmly connected to the outer shell (1), for accommodating an electrical accessory (3), wherein the socket (2) is disposed on an edge (6) of the outer shell (1) and the socket (2) is configured, when accommodating the accessory (3), for guiding the latter substantially along an inner face (7) of the outer shell (1), so that the accommodated accessory (3) extends substantially along the inner face (7) of the outer shell (1).

30 Claims, 2 Drawing Sheets

(58) Field of Classification Search
USPC ..... 2/422
See application file for complete search history.

(56) References Cited

U.S. PATENT DOCUMENTS 3,582,951 A 6/1971 Altmayer
3,885,246 A 5/1975 Tung
3,963,917 A * 6/1976 Romano ..... A42B 1/10 362/35
3,977,003 A 8/1976 Kershaw
4,077,007 A * 2/1978 McKinney ..... A42B 3/30 455/142
4,109,105 A * 8/1978 Von Statten, Jr. ..... A42B 3/30 2/422
4,130,803 A 12/1978 Thompson
4,152,553 A 5/1979 White
4,178,411 A 12/1979 Cole et al.
4,239,106 A 12/1980 Aileo
4,321,433 A 3/1982 King
4,357,711 A 11/1982 Drefko et al.
4,400,591 A * 8/1983 Jennings ..... A42B 3/30 2/424
4,466,138 A 8/1984 Gessalin
4,519,099 A 5/1985 Kamiya et al.
4,563,392 A 1/1986 Harpell et al.
4,719,462 A 1/1988 Hawkins
4,729,132 A 3/1988 Fierro
4,833,726 A * 5/1989 Shinoda ..... A42B 3/30 381/376
4,903,350 A 2/1990 Gentes et al.
4,950,439 A 8/1990 Smith et al.
5,119,505 A 6/1992 Tisseront et al.
5,136,567 A 8/1992 Nagahara et al.
5,136,657 A 8/1992 Hattori
5,142,700 A 8/1992 Reed
5,183,701 A 2/1993 Jacobs et al.
5,291,203 A 3/1994 Schneck
5,327,588 A * 7/1994 Garneau ..... A42B 3/0493 2/209.13
5,329,637 A * 7/1994 Walker ..... A42B 3/044 455/100
5,357,409 A 10/1994 Glatt
5,438,702 A 8/1995 Jackson
5,448,780 A 9/1995 Gath
5,508,900 A 4/1996 Norman
5,615,410 A 3/1997 DeMars
5,683,831 A * 11/1997 Baril ..... G02B 27/0176 429/96
5,718,004 A 2/1998 Broersma et al.
5,743,621 A * 4/1998 Mantha ..... A42B 3/044 362/184
5,749,096 A 5/1998 Fergason et al.
5,862,528 A 1/1999 Saijo et al.
5,886,667 A 3/1999 Bondyopadhayay
5,931,559 A 8/1999 Pfaeffle
5,996,128 A 12/1999 Yanagihara
6,009,563 A 1/2000 Swanson et al.
6,081,929 A 7/2000 Rothrock et al.
6,336,220 B1 1/2002 Sacks et al.
6,464,369 B1 * 10/2002 Vega ..... A42B 3/044 362/105
6,691,325 B1 * 2/2004 Pelletier ..... A42B 3/0433 2/422
6,701,537 B1 * 3/2004 Stamp ..... H05B 3/84 2/424
7,377,666 B1 * 5/2008 Tyler ..... A61F 11/14 362/311.06
7,532,163 B2 5/2009 Chang et al.
7,555,312 B2 * 6/2009 Kim ..... H04M 1/0237 348/14.02
7,555,788 B2 7/2009 Schimpf
7,901,104 B2 3/2011 McLean et al.
8,001,623 B2 * 8/2011 Gertsch ..... A42B 3/042 2/410
8,009,229 B1 8/2011 Peterson
8,245,326 B1 * 8/2012 Tolve ..... A42B 3/306 2/422
8,544,399 B2 10/2013 Miloslavsky
8,545,959 B2 10/2013 McGuire, Jr. et al.
8,667,617 B2 3/2014 Glezerman et al.
8,853,105 B2 10/2014 Bhatnagar et al.
8,908,389 B2 * 12/2014 Teetzel ..... H02J 1/00 361/807
9,070,978 B2 * 6/2015 Boni ..... H01Q 1/32
9,247,779 B1 2/2016 Aloumanis et al.
9,445,639 B1 9/2016 Aloumanis et al.
9,456,649 B2 * 10/2016 Basson ..... A42B 3/042
9,486,027 B2 * 11/2016 Dey ..... H04Q 9/00
9,585,433 B1 3/2017 Heimer et al.
9,686,136 B1 * 6/2017 Dey ..... H04W 4/70
9,711,146 B1 7/2017 Cronin
9,833,933 B2 12/2017 Cadens Ballarin
9,968,153 B2 * 5/2018 Thompson ..... F21V 23/0414
10,051,908 B2 * 8/2018 Redpath ..... A42B 3/04
10,160,156 B2 12/2018 Pourboghrat et al.
10,219,571 B1 3/2019 Aloumanis et al.
10,383,384 B2 8/2019 Zhavoronkov et al.
10,779,604 B2 * 9/2020 Lebel ..... A42B 3/16
10,806,204 B2 * 10/2020 Pritz ..... A42B 3/22
10,814,524 B2 10/2020 Prins et al.
10,856,599 B1 * 12/2020 Cuenca ..... A42B 3/306
11,278,076 B2 3/2022 Suddaby
11,633,303 B2 4/2023 Persson et al.
11,660,846 B2 5/2023 Drzal et al.
2005/0017911 A1 1/2005 Lee
2006/0232955 A1 10/2006 Labine
2006/0277664 A1 12/2006 Akhtar et al.
2007/0220662 A1 9/2007 Pierce
2007/0289044 A1 * 12/2007 Ellis ..... H04B 1/08 2/6.2
2008/0068825 A1 3/2008 Harris
2008/0130271 A1 * 6/2008 Harris ..... A42B 3/0406 362/105
2009/0064386 A1 3/2009 Rogers
2009/0158508 A1 6/2009 Quaranta et al.
2009/0199317 A1 8/2009 Schwiers et al.
2010/0175172 A1 * 7/2010 Dempsey ..... A42B 3/042 2/422
2010/0287687 A1 11/2010 Ho
2011/0302701 A1 12/2011 Kuo
2012/0011631 A1 1/2012 Crossman et al.
2012/0077438 A1 * 3/2012 Jung ..... A42B 3/30 455/41.2
2012/0189153 A1 * 7/2012 Kushnirov ..... H04M 1/05 381/375
2012/0272435 A1 11/2012 Glezerman et al.
2013/0007949 A1 * 1/2013 Kurs ..... H02J 50/70 2/410
2013/0081199 A1 4/2013 Nimura
2013/0176183 A1 7/2013 Boni et al.
2013/0190052 A1 7/2013 Lundell
2013/0305437 A1 11/2013 Weller et al.
2014/0000013 A1 1/2014 Redpath et al.
2014/0000014 A1 * 1/2014 Redpath ..... A42B 3/04 2/422
2014/0020159 A1 * 1/2014 Teetzel ..... A42B 3/04 2/422
2014/0109297 A1 4/2014 Lanez
2014/0189938 A1 * 7/2014 Redpath ..... A42B 3/0406 2/422
2014/0362244 A1 12/2014 Martin
2015/0038199 A1 2/2015 Shirashi
2015/0223547 A1 8/2015 Wibby
2015/0282549 A1 * 10/2015 Lebel ..... A42B 3/04 2/422
2016/0100649 A1 * 4/2016 Glezerman ..... A42B 3/30 455/41.2
2016/0106174 A1 4/2016 Chung et al.
2016/0213088 A1 * 7/2016 Dey ..... H04Q 9/00
2016/0249700 A1 * 9/2016 Zhavoronkov ..... A42B 3/0453 2/421
2017/0006955 A1 * 1/2017 Dow, II ..... A42B 3/10

(56) References Cited

U.S. PATENT DOCUMENTS

| | | | | |
|---|---|---|---|---|
| 2017/0052000 | A1* | 2/2017 | White | A42B 3/288 |
| 2017/0367433 | A1 | 12/2017 | Frett | |
| 2018/0221915 | A1 | 8/2018 | Simor et al. | |
| 2018/0272928 | A1 | 9/2018 | Boksteyn | |
| 2018/0289095 | A1* | 10/2018 | Catterson | H04B 1/385 |
| 2019/0104797 | A1 | 4/2019 | Teetzel et al. | |
| 2019/0191808 | A1 | 6/2019 | Becker et al. | |
| 2019/0269193 | A1 | 9/2019 | Benyola | |
| 2019/0320753 | A1 | 10/2019 | Le et al. | |
| 2019/0380417 | A1 | 12/2019 | Zhavoronkov et al. | |
| 2019/0387829 | A1 | 12/2019 | Becker et al. | |
| 2020/0015537 | A1 | 1/2020 | Becker et al. | |
| 2020/0037693 | A1 | 2/2020 | Klimek et al. | |
| 2020/0305532 | A1 | 10/2020 | Lange et al. | |

FOREIGN PATENT DOCUMENTS

| | | | | |
|---|---|---|---|---|
| CN | 1715734 | A | 1/2006 | |
| CN | 102791157 | A | 11/2012 | |
| CN | 202919121 | U | 5/2013 | |
| CN | 104871384 | A | 8/2015 | |
| CN | 204949670 | U | 1/2016 | |
| CN | 205106513 | U | 3/2016 | |
| CN | 206043574 | U | 3/2017 | |
| CN | 106659261 | A | 5/2017 | |
| CN | 206560075 | U | 10/2017 | |
| DE | 3042159 | A1 | 6/1982 | |
| DE | 8226935 | U1 | 2/1983 | |
| DE | 29519601 | U1 | 2/1996 | |
| DE | 29906107 | U1 | 7/1999 | |
| DE | 29914563 | U1 | 1/2000 | |
| DE | 102005038893 | A1 | 3/2006 | |
| DE | 202011051831 | U1 | 11/2011 | |
| DE | 102015216835 | A1 | 3/2017 | |
| DE | 102016115889 | A1 | 3/2018 | |
| EP | 0412205 | A1 | 2/1991 | |
| EP | 1393643 | A1 | 3/2004 | |
| EP | 2183989 | A1 | 5/2010 | |
| FR | 2335169 | A1 | 7/1977 | |
| FR | 2668901 | A1 | 5/1992 | |
| GB | 826012 | A | 12/1959 | |
| GB | 974901 | A | 11/1964 | |
| GB | 2059206 | A | 4/1981 | |
| GB | 2254528 | A | 10/1992 | |
| JP | S6468507 | A | 3/1989 | |
| JP | 2000328342 | A | 11/2000 | |
| JP | 2005060889 | A | 3/2005 | |
| JP | 2011-002958 | A | 1/2011 | |
| KR | 20010011095 | A | 2/2001 | |
| KR | 101530061 | B1 | 6/2015 | |
| WO | 2004032658 | A1 | 4/2004 | |
| WO | 2011129576 | A2 | 10/2011 | |
| WO | 2012006653 | A1 | 1/2012 | |
| WO | 2012017836 | A1 | 2/2012 | |
| WO | 2012148519 | A1 | 11/2012 | |
| WO | 2016001915 | A2 | 1/2016 | |
| WO | WO-2016001915 | A1 * | 1/2016 | H04B 1/385 |
| WO | 2016022984 | A1 | 2/2016 | |
| WO | 2018/043025 | A1 | 3/2018 | |

OTHER PUBLICATIONS

Written Opinion for Application No. PCT/EP2017/071259, issued Dec. 14, 2017, 8 pages.

Wikipedia, Wireless Personal Area Network, https://de.wikipedia.org/w/index.php?title=Wireless_Personal_Area_Network, printed Mar. 27, 2018, 4 pages.

Rajpurohit, A. "Fiber Reinforced Composites: Advances in Manufacturing Techniques.", Researchgate; https://www.researchgate.net/publication/279885386. (Year: 2014).

D'Hooghe et al., Thermoplastic Composite Technology; Tougher Than You Think. Adv Mat. 2000;12(23):1865-1868.

* cited by examiner

PROTECTIVE HELMET

CROSS-REFERENCE TO RELATED APPLICATIONS

This application is a national stage application of international application no. PCT/EP2017/071260 filed Aug. 23, 2017, entitled "Protective Helmet," claiming priority to German application no. DE 10 2016 115 905.0 filed Aug. 26, 2016, which are hereby expressly incorporated by reference as part of the present disclosure.

FIELD OF THE INVENTION

The present disclosure generally relates to a protective helmet, for example, a protective motorcycle helmet.

BACKGROUND

Modern protective helmets not only have mechanical devices and features such as a visor, a ventilation device and turbulators, but increasingly also additional electric devices—here and hereinafter referred to as accessories—that can be affixed to the protective helmet.

The manner of attaching of such an accessory generally constitutes a challenge. A first option is to push such an accessory into the protective helmet, e.g. using a fastening strap, which is inserted between a layer of expanded polystyrene and padding for fastening purposes. This approach is advantageous in that no special fastening means need be provided on the protective helmet itself, and that therefore, an attachment to virtually any protective helmet is possible. A drawback is that the accessory is protected only to a small degree from being inadvertently detached from the protective helmet by this type of attachment.

In contrast, another option is to provide a pre-configured socket on an external surface of the outer shell of the protective helmet, into which socket the accessory can then be inserted. By providing respective devices for attachment to the socket and to the accessory, a reliable attachment of the accessory can thus be achieved. A drawback, however, is that, in order to provide such a socket, the outer shell must be adapted with respect to, on the one hand, its outer shape and, on the other hand, to a substantial extent in such a manner that the socket can be incorporated. However, with respect to the function of the outer shell as a hard layer for distributing impact forces, this is problematic.

SUMMARY

Therefore, it is an object to develop and improve a protective helmet in such a way that such an accessory can be reliably placed on the protective helmet and that the function of the outer shell is affected as little as possible in the process.

The socket may be designed and disposed in such a way that the accommodated accessory can be placed underneath the outer shell, namely in such a manner that the accessory effectively rests against the outer shell. In this way, a specially adapted attaching device for the accessory may be provided so that the attachment is secure and reliable. On the other hand, neither a substantial adaptation of the outer shell itself nor any substantial enlargement of the protective helmet as a whole is necessary. As a result, the respective advantages of the above-described approaches are combined with each other.

The protective helmet according to at least some embodiments, which may be a protective motorcycle helmet, comprises an outer shell for distributing impact forces and a socket, which is firmly connected to the outer shell, for accommodating an electrical accessory, wherein the socket is disposed on an edge of the outer shell and the socket is configured, when accommodating the accessory, for guiding the latter substantially along an inner face of the outer shell, so that the accommodated accessory extends substantially along the inner face of the outer shell. In the process, only a part of the accessory may be accommodated by the socket and, correspondingly, only a part of the accommodated accessory may extend along the inner face of the outer shell. However, this may be the major part of the accessory. Due to the fact that a remaining part of the accessory thus does not extend along the inner face of the outer shell, this remaining part stays accessible and may therefore be used for operating the accessory, for example.

This accessory may be any electrical or electronic device. The inner face of the outer shell is the concave side of the outer shell, and thus the side by which the head of the wearer of the protective helmet is accommodated. The above extent of the accommodated accessory substantially along the inner face of the outer shell means that the accommodated accessory is substantially coplanar, i.e. parallel, to an imaginary tangential plane of the outer shell at the location of the outer shell closest to the accommodated accessory. In this case, the accessory may have a substantially flat extent and the above coplanar orientation may relate to the plane defined by this substantially flat extent.

At least some embodiments of the protective helmet are characterized in that the protective helmet has an inner layer accommodated by the outer shell for damping impact forces, and that the accommodated accessory is disposed between the outer shell and the inner layer. This arrangement ensures that the shape of the outer shell need not be altered and that the protective effect both of the outer shell and the inner layer can be largely maintained.

Another embodiment of the protective helmet is characterized in that the socket has a frame, which may consist substantially of plastic and is disposed inside the outer shell, for positively accommodating the accessory with a frame opening for inserting the accessory. As was already indicated above, a part of the accommodated accessory may protrude from the frame, and especially from the frame opening.

In at least some embodiments having a frame, the frame can house at least a first portion of an electrical accessory within the outer shell and at least a portion of the at least a first portion within the frame and with the entirety of the at least a first portion and an entirety of the at least a portion of the first portion between the inner layer and the outer shell. In such embodiments, when the helmet includes an electrical accessory therein, at least a first portion of the electrical accessory is located within the outer shell and at least a portion of the at least a first portion is located within the frame, and an entirety of the at least a first portion and an entirety of the at least a portion of the first portion is located between the inner layer and the outer shell.

In this case it is provided, according to at least some embodiments of the protective helmet, that the frame is in positive engagement for lateral retention with the accommodated accessory in at least one retaining direction, which at least one retaining direction is substantially orientated parallel to the outer shell at the location of engagement for lateral retention. Such an engagement for lateral retention prevents the accommodated accessory from slipping along the outer shell. The parallel orientation relative to the outer shell may—in analogy to the above coplanar orientation—be assessed by means of an imaginary tangential plane of the outer shell at the location of engagement for lateral retention, or the place of the outer shell closest to the location of engagement for lateral retention. The frame may be in positive engagement for lateral retention with the accommodated accessory on both sides in the at least one retaining direction. Thus, the accessory is effectively prevented from slipping in both orientations of the retaining direction.

In at least some embodiments having a frame, the frame extends along a front end and an opposing rear end of the electrical accessory and/or the frame extends adjacent an upper end of the electrical accessory. In some such embodiment, the frame extends adjacent at least four ends of the electrical accessory.

At least some embodiments of the protective helmet are characterized in that the retaining direction is orientated substantially parallel to a circumferential direction of the outer shell at the location of engagement for lateral retention. Here and hereinafter, this circumferential direction is to be understood to be a direction which is both horizontal—i.e. relative to a person wearing the protective helmet—as well as tangential to the outer shell at the location of engagement for lateral retention—i.e. of the above positive engagement.

Another embodiment of the protective helmet is characterized in that the frame is adjacent to a lower edge of the outer shell and that the frame opening is substantially disposed at the lower edge of the outer shell. Here and hereinafter, the directional indication "lower" refers to a person wearing the protective helmet. This arrangement of the frame and the frame opening enables a convenient access both for accommodation and for removing the accessory from the socket. In at least some embodiments, the frame, starting at the frame opening, substantially extends along the outer shell. This extent may be such that the accessory is inserted into the frame substantially in a vertically upward direction. Here and hereinafter, the directional indication "upward" also refers to a person wearing the protective helmet.

According to at least some embodiments of the protective helmet, it is provided that the protective helmet comprises a helmet trim which is firmly connected to the outer shell and which may substantially consist of plastic, for at least partially covering the edge of the outer shell. Such a helmet trim protects the vulnerable edge of the outer shell, for example, when the protective helmet is dropped. The helmet trim also serves in at least some embodiments, for delimiting the protective helmet in a downward direction. In at least some embodiments, the frame is firmly and positively connected to the helmet trim.

At least some embodiments of the protective helmet are characterized in that the frame opening is disposed laterally offset from a vertical central longitudinal plane of the protective helmet. The central longitudinal plane is described by a vector in the longitudinal direction of the protective helmet, which longitudinal direction is defined, here and hereinafter, as the viewing direction of a person wearing the protective helmet, and a vector in a vertical direction, which vertical direction is defined, in particular, in accordance with the above-mentioned "upward" direction.

Therefore, a lateral offset from this vertical central longitudinal plane is an offset perpendicular to the central longitudinal plane, and thus, in a horizontal transverse direction, with respect to the above viewing direction of a person wearing the protective helmet. Here, the frame opening may also be disposed substantially centrally between a maximally rearward and a maximally lateral position and along the lower, edge of the outer shell. This arrangement corresponds to a region of the lower edge situated diagonally offset in a rearward direction from an imaginary center of the protective helmet. The region is particularly suitable for the person wearing the protective helmet to conveniently grip the protective helmet without limiting the visual field of the protective helmet.

Another embodiment of the protective helmet is characterized in that the socket has a snap-in device for a positive engagement for holding the accessory. The positive engagement may serve for holding the accessory in the frame. In at least some embodiments, the snap-in device is disposed spaced apart from the frame opening. This may cause the snap-in device to be covered by an accessory accommodated by the frame. In other words, the snap-in device is in that case no longer exposed, so that an inadvertent release of the positive engagement for holding the accessory by accidentally touching the snap-in device is prevented.

According to a at least some embodiments of the protective helmet, it is provided that the socket has a wall against which the accommodated accessory rests in a flat manner, and that the snap-in device has at least one hook, which at least one hook protrudes in an adjustable manner from the wall for positive engagement in order to hold the accessory. In at least some embodiments, it may be that the frame of the socket includes the wall. The above adjustability of the hook may be provided by the bendability of an arm of the frame, on which arm the hook is disposed. It may also be that the at least one the hook is disposed in such a way that, by inserting a release device between the wall and the accommodated accessory, it can be pressed into the wall so that the positive engagement for holding the accessory is released. Such a release device may be configured to be flat or card-like. Consequently, the snap-in device is configured to release the positive engagement for holding the accessory in response to the release device being used. This enables a reliable removal of the accessory if, and only if, removal is desired.

At least some embodiments of the protective helmet are characterized in that the protective helmet comprises an electric and electrically operated module device which is coupled to the outer shell and electrically connected to the socket, and that the socket has a pole assembly for the detachable electric coupling of the accommodated accessory. On the one hand, this electric coupling may be contact-free, e.g. by means of magnetic induction. This electric coupling may also contain a mechanical contacting portion. Accordingly, the pole assembly may be a pole contact assembly for detachable electrical contacting. In this way, an accessory accommodated by the socket is reliably electrically connected to the module device. This is advantageous if the module device and the accessory are two components of a combined overall device that becomes functional only due to this connection. The accessory is then a replaceable constituent of this overall device, whereas the module device is firmly integrated with the outer shell and thus, the protective helmet as a whole. Here, the pole contact assembly may also have a plurality of single contacts for respectively contacting the accessory. The module device may be an electronic device, or also a digital electronic device.

Another embodiment of the protective helmet is characterized in that the pole assembly, such as the above pole contact assembly, has at least one plug contact for positive connection with the accessory. Then, the pole assembly also contributes to the mechanical connection of the accessory to the socket. The pole contact assembly may also comprise at least one sliding contact for the connection without positive fit to the accessory. Alternatively or additionally, the pole contact assembly may have further types of contacts.

In principle, this accessory may be any electrical device. For example, the accessory may also be an electrical energy storage unit and, correspondingly, an electrical battery. The accessory may also be a radio device for receiving a radio transmission, wherein it is possible to receive analog radio—frequency-modulated or amplitude-modulated—and/or digital radio. In addition to this option, the accessory may be an electronic device, such as a digital electronic device. According to a at least some embodiments of the protective helmet, it is provided that the accessory is a digital device for wireless communication. The digital device may be a radio module for a Wireless Personal Area Network (WPAN), wherein the digital device may be, for example, a radio module for Bluetooth. In this context, the module device may moreover be an antenna for high-frequency transmission. In this manner, the protective helmet can provide such replaceable radio modules with an already pre-installed antenna on the protective helmet.

At least some embodiments of the protective helmet are characterized in that the protective helmet comprises an accessory accommodated by the socket, that the accessory has pushbuttons for operation, and that the pushbuttons protrude from the socket. In at least some embodiments, the pushbuttons serve for operating the accessory. In this case, the pushbuttons may protrude from the frame. In this manner, both a largely covered arrangement of the accessory and an accessibility of the operating means of the accessory are obtained.

Another embodiment of the protective helmet is characterized in that the pushbuttons are disposed on the accessory in such a way that an operation of the pushbuttons pushes the accessory in an insertion direction of the socket, and in some embodiments, of the frame. The operation of the pushbuttons—which, due to the fact that the operator will generally wear motorcycle gloves, may be carried out in a comparatively crude manner—thus pushes the accessory into the socket, so that the risk of an inadvertent release of the accessory is minimized even in the case of imprecise operation.

This summary is not exhaustive of the scope of the present aspects and embodiments. Thus, while certain aspects and embodiments have been presented and/or outlined in this summary, it should be understood that the present aspects and embodiments are not limited to the aspects and embodiments in this summary. Indeed, other aspects and embodiments, which may be similar to and/or different from, the aspects and embodiments presented in this summary, will be apparent from the description, illustrations, and/or claims, which follow.

It should also be understood that any aspects and embodiments that are described in this summary and do not appear in the claims that follow are preserved for later presentation in this application or in one or more continuation patent applications.

BRIEF DESCRIPTION OF THE DRAWINGS

Other advantages will become apparent from the following description with reference to the Figures, which are understood not to be limiting.

DETAILED DESCRIPTION

Figure 1:
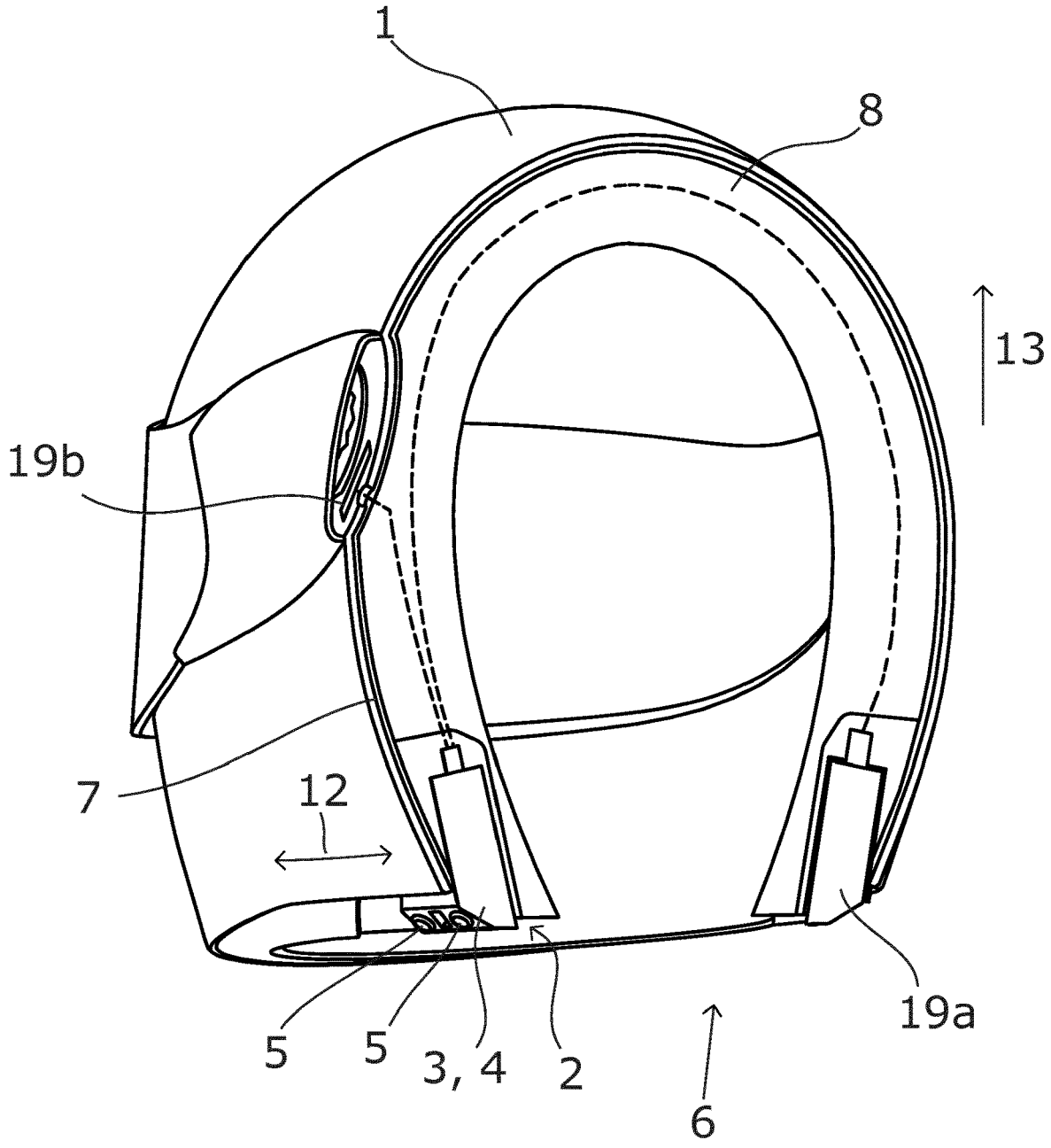
FIG. 1 is a schematic rear sectional view of a protective helmet with an accommodated accessory.

The protective helmet illustrated in FIG. 1 is a protective motorcycle helmet. It has an outer shell 1 made from glass fibers with an added special resin, with which a socket 2 for accommodating an electric accessory 3, which is a radio module 4 for Bluetooth with pushbuttons 5 for operation, is firmly connected in a manner not shown in detail here. In the present case, only FIG. 1 shows the accessory 3 accommodated by the socket 2. The socket 2 is recognizably disposed on an edge 6 of the outer shell 1, which edge 6 is in this case, specifically, the lower edge and also the only edge 6 of the outer shell in the present case. It is also apparent from FIG. 1 that the socket 2 is configured in such a way that the accommodated accessory 3 extends substantially along the inner face 7 of the outer shell 1 in relation to the region of the outer shell 1 to which the accessory 3 or the socket 2 is adjacent. The accommodated accessory 3 is disposed between the outer shell 1 and the inner layer 8 of expanded polystyrene (EPS). In the embodiment shown in FIG. 1, the entirety of the inner layer 8 is located within the outer shell 1 and the inner surface of the outer shell 1 defines a curved surface, and at least a portion of the inner layer 8 extends against said curved surface.

Figure 2:
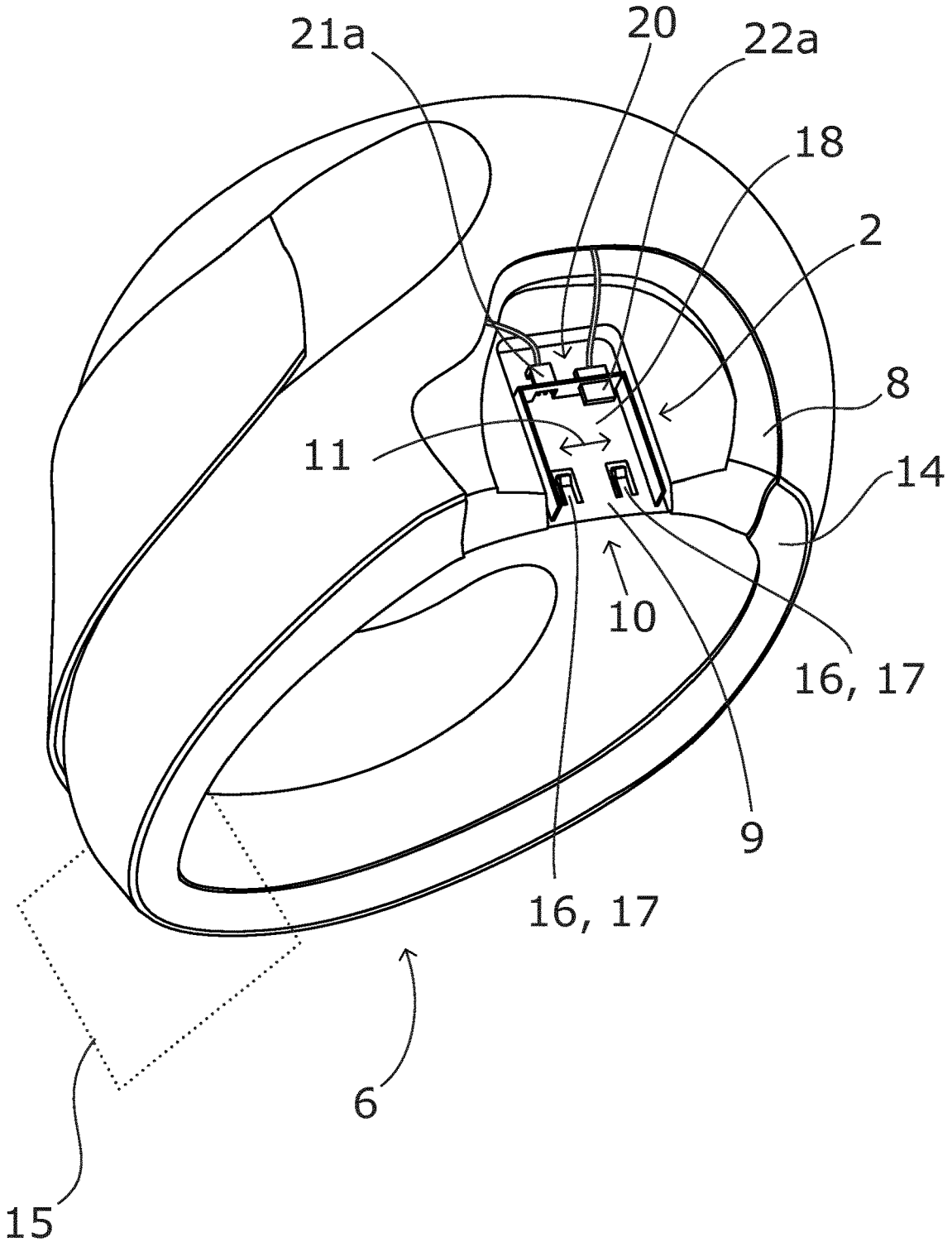
FIG. 2 is a schematic perspective sectional view of the socket of the protective helmet of FIG. 1 without the accommodated accessory.

The socket 3 has a frame 9 of plastic which is shown only in FIG. 2 and disposed inside the outer shell 1, and which, in turn, has a frame opening 10. In the particular embodiment of FIG. 2, the frame does not extend beyond the lower edge of the outer shell. In the illustrated embodiment, there is a positive and, in some embodiments, bilateral engagement for lateral retention between the frame 9 and the accessory 3 in a retaining direction 11 shown in FIG. 2, so that the accommodated accessory 3 cannot slip in this retaining direction 11. This retaining direction 11 in this case corresponds to a local circumferential direction 12 of the outer shell 1 shown in FIG. 1. Pushbuttons 5 of the accommodated accessory 3 protrude from this frame 9, so that the possibility of operating them is provided. Their operation always pushes the accessory 3 into the frame 9.

For inserting the accessory 3, the latter is inserted substantially in the vertically upward direction 13 into the frame 9, through the frame opening 10. A helmet trim 14 made of plastic covers the lower edge 6 of the outer shell 1. The helmet 14 is firmly connected to the outer shell 1, and the frame 9, in turn, to the helmet trim 14 in a manner not shown here in detail. As can be seen, the frame opening 11 is disposed laterally offset from a vertical central longitudinal plane 15 indicated in FIG. 2.

With respect to the details of the socket 2, FIG. 2 shows hooks 16 of the socket assembly 2 that form a snap-in device 17 for holding the accessory 3 in the frame 10. In this case, the hooks 16 protrude from a wall 18 of the frame 10. The accessory 3 has engagement surfaces, which correspond to these hooks 16 but are not shown here. As can be seen, the hooks 16 are spaced apart from the frame opening 11, so that the release of their positive engagement for holding the accessory 3 with the accessory 3 is effected by means of a, for example card-like, release device, which can be inserted into the frame 10 between the accessory 3 and the wall 18, and which is not shown here. The hooks 16 are disposed on bendable arms of the snap-in device 17, so that they are bent away when the accessory 3 is inserted.

FIG. 1 also shows two electrical module devices 19*a, b*, which are electrically connected to the socket 2. The module device 19*a* is a battery detachably disposed in a battery accommodating portion. The module device 19*b* is an antenna for high-frequency transmission. The radio module 4 utilizes the antenna for Bluetooth transmission and is supplied with electricity by the battery.

A pole assembly 20 for electrically coupling and, in this case, contacting the accessory 3, which is, in in some embodiments, a pole contact assembly, is apparent from FIG. 2, wherein the pole assembly 20 has both a plug contact 21*a* for a positive connection and a sliding contact 22*a* for a connection without a positive fit, in each case with the accessory 3 or the electrical mating contacts not shown here.

While the above describes certain embodiments, those skilled in the art should understand that the foregoing description is not intended to limit the spirit or scope of the present disclosure. It should also be understood that the embodiments of the present disclosure described herein are merely exemplary and that a person skilled in the art may make any variations and modification without departing from the spirit and scope of the disclosure. All such variations and modifications, including those discussed above, are intended to be included within the scope of the disclosure.

PROTECTIVE HELMET

The invention relates to a protective helmet, and in particular to a protective motorcycle helmet.

Modern protective helmets not only have mechanical devices and features such as a visor, a ventilation device and turbulators, but increasingly also additional electric devices—here and hereinafter referred to as accessories—that can be affixed to the protective helmet.

The manner of attaching of such an accessory generally constitutes a challenge. A first option is to push such an accessory into the protective helmet, e.g. using a fastening strap, which is inserted between a layer of expanded polystyrene and padding for fastening purposes. This approach is advantageous in that no special fastening means need be provided on the protective helmet itself, and that therefore, an attachment to virtually any protective helmet is possible. A drawback is that the accessory is protected only to a small degree from being inadvertently detached from the protective helmet by this type of attachment.

In contrast, another option is to provide a pre-configured socket on an external surface of the outer shell of the protective helmet, into which socket the accessory can then be inserted. By providing respective devices for attachment to the socket and to the accessory, a reliable attachment of the accessory can thus be achieved. A drawback, however, is that, in order to provide such a socket, the outer shell must be adapted with respect to, on the one hand, its outer shape and, on the other hand, to a substantial extent in such a manner that the socket can be incorporated. However, with respect to the function of the outer shell as a hard layer for distributing impact forces, this is problematic.

Therefore, the object of the invention is to develop and improve a protective helmet in such a way that such an accessory can be reliably placed on the protective helmet and that the function of the outer shell is affected as little as possible in the process.

This object is achieved by a protective helmet with the features of claim 1.

The insight that the socket may be designed and disposed in such a way that the accommodated accessory can be placed underneath the outer shell, namely in such a manner that the accessory effectively rests against the outer shell, is essential to the invention. In this way, a specially adapted attaching device for the accessory may be provided so that the attachment is secure and reliable. On the other hand, neither a substantial adaptation of the outer shell itself nor any substantial enlargement of the protective helmet as a whole is necessary. As a result, the respective advantages of the above-described approaches are combined with each other.

The protective helmet according to the invention, which may be, in particular, a protective motorcycle helmet, comprises an outer shell for distributing impact forces and a socket, which is firmly connected to the outer shell, for accommodating an electrical accessory, wherein the socket is disposed on an edge of the outer shell and the socket is configured, when accommodating the accessory, for guiding the latter substantially along an inner face of the outer shell, so that the accommodated accessory extends substantially along the inner face of the outer shell. In the process, only a part of the accessory may be accommodated by the socket and, correspondingly, only a part of the accommodated accessory may extend along the inner face of the outer shell. Preferably, however, this is the major part of the accessory. Due to the fact that a remaining part of the accessory thus does not extend along the inner face of the outer shell, this remaining part stays accessible and may therefore be used for operating the accessory, for example.

This accessory may be any electrical and, in particular, electronic device. The inner face of the outer shell is the concave side of the outer shell, and thus the side by which the head of the wearer of the protective helmet is accommodated. The above extent of the accommodated accessory substantially along the inner face of the outer shell means that the accommodated accessory is substantially coplanar, i.e. parallel, to an imaginary tangential plane of the outer shell at the location of the outer shell closest to the accommodated accessory. In this case, the accessory may have a substantially flat extent and the above coplanar orientation may relate to the plane defined by this substantially flat extent.

A preferred embodiment of the protective helmet is characterized in that the protective helmet has an inner layer accommodated by the outer shell for damping impact forces, and that the accommodated accessory is disposed between the outer shell and the inner layer. This arrangement ensures that the shape of the outer shell need not be altered and that the protective effect both of the outer shell and the inner layer can be largely maintained.

Another preferred embodiment of the protective helmet is characterized in that the socket has a frame, which preferably consists substantially of plastic and is disposed inside the outer shell, for positively accommodating the accessory with a frame opening for inserting the accessory. As was already indicated above, a part of the accommodated accessory may protrude from the frame, and especially from the frame opening.

In this case it is provided, according to a preferred embodiment of the protective helmet, that the frame is in positive engagement for lateral retention with the accommodated accessory in at least one retaining direction, which at least one retaining direction is substantially orientated parallel to the outer shell at the location of engagement for lateral retention. Such an engagement for lateral retention prevents the accommodated accessory from slipping along the outer shell. The parallel orientation relative to the outer shell may—in analogy to the above coplanar orientation— be assessed by means of an imaginary tangential plane of the outer shell at the location of engagement for lateral retention, or the place of the outer shell closest to the location of engagement for lateral retention. Preferably, the frame is in positive engagement for lateral retention with the accommodated accessory on both sides in the at least one retaining direction. Thus, the accessory is effectively prevented from slipping in both orientations of the retaining direction.

A preferred embodiment of the protective helmet is characterized in that the retaining direction is orientated substantially parallel to a circumferential direction of the outer shell at the location of engagement for lateral retention. Here and hereinafter, this circumferential direction is to be understood to be a direction which is both horizontal—i.e. relative to a person wearing the protective helmet—as well as tangential to the outer shell at the location of engagement for lateral retention—i.e. of the above positive engagement.

Another preferred embodiment of the protective helmet is characterized in that the frame is adjacent to a lower edge of the outer shell and that the frame opening is substantially disposed at the lower edge of the outer shell. Here and hereinafter, the directional indication "lower" refers to a person wearing the protective helmet. This arrangement of the frame and the frame opening enables a convenient access both for accommodation and for removing the accessory from the socket. It is also preferred that the frame, starting at the frame opening, substantially extends along the outer shell. In particular, this extent may be such that the accessory is inserted into the frame substantially in a vertically upward direction. Here and hereinafter, the directional indication "upward" also refers to a person wearing the protective helmet.

According to a preferred embodiment of the protective helmet, it is provided that the protective helmet comprises a helmet trim which is firmly connected to the outer shell and which, preferably, substantially consists of plastic, for at least partially covering the, in particular lower, edge of the outer shell. Such a helmet trim protects the vulnerable edge of the outer shell, for example, when the protective helmet is dropped. Preferably, the helmet trim also serves, in particular, for delimiting the protective helmet in a downward direction. It is also preferred that the frame is firmly and preferably positively connected to the helmet trim.

A preferred embodiment of the protective helmet is characterized in that the frame opening is disposed laterally offset from a vertical central longitudinal plane of the protective helmet. The central longitudinal plane is described by a vector in the longitudinal direction of the protective helmet, which longitudinal direction is defined, here and hereinafter, as the viewing direction of a person wearing the protective helmet, and a vector in a vertical direction, which vertical direction is defined, in particular, in accordance with the above-mentioned "upward" direction. Therefore, a lateral offset from this vertical central longitudinal plane is an offset perpendicular to the central longitudinal plane, and thus, in a horizontal transverse direction, with respect to the above viewing direction of a person wearing the protective helmet. Here, it is also preferred that the frame opening is disposed substantially centrally between a maximally rearward and a maximally lateral position along the, in particular lower, edge of the outer shell. This arrangement corresponds to a region of the lower edge situated diagonally offset in a rearward direction from an imaginary center of the protective helmet. The region is particularly suitable for the person wearing the protective helmet to conveniently grip the protective helmet without limiting the visual field of the protective helmet.

Another preferred embodiment of the protective helmet is characterized in that the socket has a snap-in device for a positive engagement for holding the accessory. In particular, the positive engagement may serve for holding the accessory in the frame. Preferably, the snap-in device is disposed spaced apart from the frame opening. In particular, this may cause the snap-in device to be covered by an accessory accommodated by the frame. In other words, the snap-in device is in that case no longer exposed, so that an inadvertent release of the positive engagement for holding the accessory by accidentally touching the snap-in device is prevented.

According to a preferred embodiment of the protective helmet, it is provided that the socket has a wall against which the accommodated accessory rests in a flat manner, and that the snap-in device has at least one hook, which at least one hook protrudes in an adjustable manner from the wall for positive engagement in order to hold the accessory. In particular, it may be that the frame of the socket, in particular, includes the wall. The above adjustability of the hook may be provided, in particular, by the bendability of an arm of the frame, on which arm the hook is disposed. It may also be that the at least one the hook is disposed in such a way that, by inserting a release device between the wall and the accommodated accessory, it can be pressed into the wall so that the positive engagement for holding the accessory is released. Such a release device may be configured to be flat or card-like. Consequently, the snap-in device is configured to release the positive engagement for holding the accessory in response to the release device being used. This enables a reliable removal of the accessory if, and only if, removal is desired.

A preferred embodiment of the protective helmet is characterized in that the protective helmet comprises an electric and, in particular, electrically operated module device which is, preferably firmly, coupled to the outer shell and electrically connected to the socket, and that the socket has a pole assembly for the detachable electric coupling of the accommodated accessory. On the one hand, this electric coupling may be contact-free, e.g. by means of magnetic induction. This electric coupling may also contain a mechanical contacting portion. Accordingly, the pole assembly may be a pole contact assembly for detachable electrical contacting. In this way, an accessory accommodated by the socket is reliably electrically connected to the module device. This is advantageous particularly if the module device and the accessory are two components of a combined overall device that becomes functional only due to this connection. The accessory is then a replaceable constituent of this overall device, whereas the module device is firmly integrated with the outer shell and thus, the protective helmet as a whole. Here, it is also preferred that the pole contact assembly has a plurality of single contacts for respectively contacting the accessory. The module device may be, in particular, an electronic device, or also a digital electronic device.

Another preferred embodiment of the protective helmet is characterized in that the pole assembly, preferably the above pole contact assembly, has at least one plug contact for positive connection with the accessory. Then, the pole assembly also contributes to the mechanical connection of the accessory to the socket. The pole contact assembly may also comprise at least one sliding contact for the connection without positive fit to the accessory. Alternatively or additionally, the pole contact assembly may have further types of contacts.

In principle, this accessory may be any electrical device. For example, the accessory may also be an electrical energy storage unit and, correspondingly, an electrical battery. The accessory may also be a radio device for receiving a radio transmission, wherein it is possible to receive analog radio—frequency-modulated or amplitude-modulated—and/or digital radio. In addition to this option, the accessory may be an electronic device, and especially a digital electronic device. According to a preferred embodiment of the protective helmet, it is provided that the accessory is a digital device for wireless communication. In particular, the digital device may be a radio module for a Wireless Personal Area Network (WPAN), wherein the digital device may be, in particular, a radio module for Bluetooth. In this context, the module device may moreover be an antenna for high-frequency transmission. In this manner, the protective helmet can provide such replaceable radio modules with an already pre-installed antenna on the protective helmet.

A preferred embodiment of the protective helmet is characterized in that the protective helmet comprises an accessory accommodated by the socket, that the accessory has pushbuttons for operation, and that the pushbuttons protrude from the socket. Preferably, the pushbuttons serve for operating the accessory. In this case, the pushbuttons may, in particular, protrude from the frame. In this manner, both a largely covered arrangement of the accessory and an accessibility of the operating means of the accessory are obtained.

Another preferred embodiment of the protective helmet is characterized in that the pushbuttons are disposed on the accessory in such a way that an operation of the pushbuttons pushes the accessory in an insertion direction of the socket, in particular of the frame. The operation of the pushbuttons—which, due to the fact that the operator will generally wear motorcycle gloves, may be carried out in a comparatively crude manner—thus pushes the accessory into the socket, so that the risk of an inadvertent release of the accessory is minimized even in the case of imprecise operation.

Other advantageous and preferred embodiments become apparent from the following description with reference to the Figures. In the drawing, which only illustrates a single embodiment:

FIG. 1 shows a schematic rear sectional view of an exemplary embodiment of a proposed protective helmet with an accommodated accessory, and FIG. 2 shows a schematic perspective sectional view of the socket of the protective helmet of FIG. 1 without the accommodated accessory.

The proposed protective helmet illustrated in FIG. 1 is a protective motorcycle helmet. It has an outer shell 1 made from glass fibers with an added special resin, with which a socket 2 for accommodating an electric accessory 3, which is a radio module 4 for Bluetooth with pushbuttons 5 for operation, is firmly connected in a manner not shown in detail here. In the present case, only FIG. 1 shows the accessory 3 accommodated by the socket 2. The socket 2 is recognizably disposed on an edge 6 of the outer shell 1, which edge 6 is in this case, specifically, the lower edge and also the only edge 6 of the outer shell in the present case. It is also apparent from FIG. 1, in particular, that the socket 2 is configured in such a way that the accommodated accessory 3 extends substantially along the inner face 7 of the outer shell 1, particularly in relation to the region of the outer shell 1 to which the accessory 3 or the socket 2 is adjacent. The accommodated accessory 3 is disposed between the outer shell 1 and the inner layer 8 of expanded polystyrene (EPS).

The socket 3 has a frame 9 of plastic which is shown only in FIG. 2 and disposed inside the outer shell 1, and which, in turn, has a frame opening 10. In this case, there is a positive and, in particular, bilateral engagement for lateral retention between the frame 9 and the accessory 3 in a retaining direction 11 shown in FIG. 2, so that the accommodated accessory 3 cannot slip in this retaining direction 11. This retaining direction 11 in this case corresponds to a local circumferential direction 12 of the outer shell 1 shown in FIG. 1. Pushbuttons 5 of the accommodated accessory 3 protrude from this frame 9, so that the possibility of operating them is provided. Their operation always pushes the accessory 3 into the frame 9.

For inserting the accessory 3, the latter is inserted substantially in the vertically upward direction 13 into the frame 9, through the frame opening 10. A helmet trim 14 made of plastic covers the lower edge 6 of the outer shell 1. The helmet 14 is firmly connected to the outer shell 1, and the frame 9, in turn, to the helmet trim 14 in a manner not shown here in detail. As can be seen, the frame opening 11 is disposed laterally offset from a vertical central longitudinal plane 15 indicated in FIG. 2.

With respect to the details of the socket 2, FIG. 2 shows hooks 16 of the socket assembly 2 that form a snap-in device 17 for holding the accessory 3 in the frame 10. In this case, the hooks 16 protrude from a wall 18 of the frame 10. The accessory 3 has engagement surfaces, which correspond to these hooks 16 but are not shown here. As can be seen, the hooks 16 are spaced apart from the frame opening 11, so that the release of their positive engagement for holding the accessory 3 with the accessory 3 is effected by means of a, for example card-like, release device, which can be inserted into the frame 10 between the accessory 3 and the wall 18, and which is not shown here. The hooks 16 are disposed on bendable arms of the snap-in device 17, so that they are bent away when the accessory 3 is inserted.

FIG. 1 also shows two electrical module devices 19*a, b*, which are electrically connected to the socket 2. The module device 19*a* is a battery detachably disposed in a battery accommodating portion. The module device 19*b* is an antenna for high-frequency transmission. The radio module 4 utilizes the antenna for Bluetooth transmission and is supplied with electricity by the battery.

A pole assembly 20 for electrically coupling and, in this case, contacting the accessory 3, which is, in particular, a pole contact assembly, is apparent from FIG. 2, wherein the pole assembly 20 has both a plug contact 21*a* for a positive connection and a sliding contact 22*a* for a connection without a positive fit, in each case with the accessory 3 or the electrical mating contacts not shown here.

The invention claimed is:

1. A protective helmet, comprising:

an outer shell configured for distributing impact forces, a socket adjacent to the outer shell, an inner layer located within the outer shell configured for damping impact forces, wherein the socket is located between the outer shell and the inner layer, the socket is located on an edge of the outer shell and the edge defines a lower edge of the outer shell, the socket includes a frame located inside the outer shell and between the inner layer and the outer shell, the frame has a frame opening through which an electrical accessory is insertable or removable or can protrude, the frame is adjacent to the lower edge of the outer shell and does not extend beyond the lower edge of the outer shell, and the frame opening is located at the lower edge of the outer shell, and an electrical accessory, wherein at least a first portion of the electrical accessory is located within the outer shell and at least a portion of the at least a first portion is located within the frame, and an entirety of the at least a first portion and an entirety of the at least a portion of the first portion is located between the inner layer and the outer shell.

2. The protective helmet according to claim 1, wherein the frame engages and laterally retains the electrical accessory in at least one retaining direction orientated parallel to the outer shell at a location that the frame engages and laterally retains the electrical accessory.

3. The protective helmet according to claim 2, wherein the at least one retaining direction is orientated parallel to a circumferential direction of the outer shell.

4. The protective helmet according to claim 1, wherein the protective helmet further comprises a helmet trim connected to the outer shell and configured for at least partially covering an edge of the outer shell.

5. The protective helmet according to claim 1, wherein the frame opening is laterally offset from a vertical central longitudinal plane of the protective helmet.

6. The protective helmet according to claim 1, wherein the socket has a snap-in device configured for engaging and holding the electrical accessory.

7. The protective helmet according to claim 6, wherein the socket has a wall, the electrical accessory is positioned flatly against the wall, and the snap-in device has at least one hook that adjustably protrudes from the wall and is configured for engaging and holding the electrical accessory.

8. The protective helmet according to claim 1, wherein the protective helmet comprises an electric module device coupled to the outer shell and electrically connected to the socket, and the socket has a pole assembly configured to be detachably electrically coupled to the electrical accessory.

9. The protective helmet according to claim 8, wherein the pole assembly has at least one plug contact configured for connection with the electrical accessory.

10. The protective helmet according to claim 1, wherein the protective helmet defines at least one pushbutton configured for operating the electrical accessory, wherein the at least one pushbutton protrudes from the socket.

11. The protective helmet according to claim 10, wherein the at least one pushbutton is positioned on the electrical accessory.

12. The protective helmet according to claim 1, wherein the protective helmet is a protective motorcycle helmet.

13. The protective helmet according to claim 2, wherein the frame engages and laterally retains the electrical accessory on both sides of the electrical accessory in the at least one retaining direction.

14. The protective helmet according to claim 1, wherein the frame, starting at the frame opening, extends along the outer shell.

15. The protective helmet according to claim 1, wherein the electrical accessory is oriented in the frame in a vertical direction.

16. The protective helmet according to claim 1, wherein the frame is directly attached to the inner layer.

17. The protective helmet according to claim 1, wherein, adjacent to the frame, the inner layer is configured to dampen impact forces.

18. The protective helmet according to claim 1, wherein (i) the frame extends along a front end and an opposing rear end of the electrical accessory and/or (ii) the frame extends adjacent an upper end of the electrical accessory.

19. The protective helmet according to claim 18, wherein the frame extends adjacent at least four ends of the electrical accessory.

20. The protective helmet according to claim 1, wherein an entirety of the inner layer is located within the outer shell.

21. The protective helmet according to claim 1, wherein an inner surface of the outer shell defines a curved surface, and at least a portion of the inner layer extends against said curved surface.

22. The protective helmet according to claim 1, wherein the protective helmet defines a motorcycle helmet.

23. The protective helmet according to claim 1, further including a visor.

24. The protective helmet according to claim 1, wherein the outer shell is configured to cover a chin, forehead and/or rear portion of a wearer's head when worn thereby.

25. The protective helmet according to claim 1, wherein the outer shell is configured to extend in a horizontal plane from a left side of a wearer's head to a right side of wearer's head when worn thereby.

26. The protective helmet according to claim 1, wherein no part of the outer shell is located between the socket and the inner shell.

27. A protective helmet, comprising:

an outer shell configured for distributing impact forces, a socket adjacent to the outer shell, and an inner layer located within the outer shell configured for damping impact forces, wherein the socket is located between the outer shell and the inner layer, the socket is located on an edge of the outer shell and the edge defines a lower edge of the outer shell, the socket includes a frame located inside the outer shell and between the inner layer and the outer shell, the frame has a frame opening through which an electrical accessory is insertable or removable or can protrude, the frame is adjacent to the lower edge of the outer shell and does not extend beyond the lower edge of the outer shell, the frame opening is located at the lower edge of the outer shell, and the frame is configured to house at least a first portion of an electrical accessory within the outer shell and at least a portion of the at least a first portion within the frame and with the entirety of the at least a first portion and an entirety of the at least a portion of the first portion between the inner layer and the outer shell.

28. The protective helmet according to claim 27, further including an electrical connection configured to electrically connect to an electrical accessory located in the socket.

29. The protective helmet according to claim 27, wherein, adjacent to the frame, the inner layer is configured to dampen impact forces.

30. A protective helmet, comprising:

an outer shell configured for distributing impact forces, a socket adjacent to the outer shell, an inner layer located within the outer shell configured for damping impact forces, wherein the socket is located between the outer shell and the inner layer, the socket is located on an edge of the outer shell and the edge defines a lower edge of the outer shell, the socket includes a frame located inside the outer shell and between the inner layer and the outer shell, the frame has a frame opening through which an electrical accessory is insertable or removable or can protrude, the frame is adjacent to the lower edge of the outer shell and does not extend beyond the lower edge of the outer shell, and the frame opening is located at the lower edge of the outer shell, and an electrical accessory, wherein at least a portion of the electrical accessory is located within the frame, and between the inner layer and the outer shell;

wherein (i) the frame extends along a front end and an opposing rear end of the electrical accessory and/or (ii) the frame extends adjacent an upper end of the electrical accessory.

* * * * *